US008439131B2

(12) United States Patent
Runia

(10) Patent No.: US 8,439,131 B2
(45) Date of Patent: May 14, 2013

(54) DRILL BIT ASSEMBLY AND METHOD OF PERFORMING AN OPERATION IN A WELLBORE

(75) Inventor: Douwe Johannes Runia, GS Rijswijk (NL)

(73) Assignee: Schlumberger Technology Corporation, Sugar Land, TX (US)

( * ) Notice: Subject to any disclaimer, the term of this patent is extended or adjusted under 35 U.S.C. 154(b) by 495 days.

(21) Appl. No.: 12/595,060

(22) PCT Filed: Apr. 10, 2008

(86) PCT No.: PCT/EP2008/054320

§ 371 (c)(1),
(2), (4) Date: Jan. 20, 2010

(87) PCT Pub. No.: WO2008/125581

PCT Pub. Date: Oct. 23, 2008

(65) Prior Publication Data

US 2010/0108391 A1 May 6, 2010

(30) Foreign Application Priority Data

Apr. 12, 2007 (EP) ..... 07106015

(51) Int. Cl.
*E21B 7/00* (2006.01)

(52) U.S. Cl.
USPC ..... 175/57; 175/257; 175/262; 175/285; 175/385

(58) Field of Classification Search ..... 175/57, 175/257, 262, 285, 385; 166/242.7
See application file for complete search history.

(56) References Cited

U.S. PATENT DOCUMENTS

| | | | |
|---|---|---|---|
| 5,244,050 | A | 9/1993 | Estes |
| 5,285,008 | A | 2/1994 | Sas-Jaworsky et al. |
| 5,521,592 | A | 5/1996 | Veneruso |

(Continued)

FOREIGN PATENT DOCUMENTS

| | | |
|---|---|---|
| GB | 2357787 | 7/2001 |
| WO | WO0017488 | 3/2000 |

(Continued)

OTHER PUBLICATIONS

Matula, Chuck, "Lower Risk by Logging Through the Bit," Exploration and Production Magazine, Jan. 29, 2009, pp. 1-2.

(Continued)

*Primary Examiner* — David Andrews
*Assistant Examiner* — Ronald Runyan
(74) *Attorney, Agent, or Firm* — Chamberlain Hrdlicka

(57) ABSTRACT

A drill bit assembly comprising a bit body connectable to a tubular drill string, and provided with a longitudinal passageway for an operating tool; an externally removable closure element for closing the passageway for the operating tool; and a passage tool attached to or connectable to the closure element in its closing position, wherein the passage tool comprises a lower part to which the closure element is attached or connectable, which lower part is arranged so that it can be moved out of the bit body together with the closure element, and an upper tubular part which is arranged so that it can be moved along the passageway in the bit body, the upper tubular part forming a passage with a downstream opening for the operating tool when the lower part of the passage tool has been moved out of the bit body.

8 Claims, 5 Drawing Sheets

U.S. PATENT DOCUMENTS

| | | | | |
|---|---|---|---|---|
| 6,269,891 | B1 | 8/2001 | Runia | |
| 6,443,247 | B1 | 9/2002 | Wardley | |
| 6,527,513 | B1 | 3/2003 | Van Drentham-Susman et al. | |
| 6,561,278 | B2 | 5/2003 | Restarick et al. | |
| 6,663,453 | B2 | 12/2003 | Quigley et al. | |
| 6,702,041 | B2 | 3/2004 | Runia | |
| 7,134,493 | B2 | 11/2006 | Runia | |
| 7,140,454 | B2 | 11/2006 | Runia | |
| 7,188,672 | B2 | 3/2007 | Berkheimer et al. | |
| 7,207,398 | B2 * | 4/2007 | Runia et al. | 175/61 |
| 7,281,592 | B2 | 10/2007 | Runia et al. | |
| 7,287,609 | B2 | 10/2007 | Runia et al. | |
| 7,296,639 | B2 | 11/2007 | Millar et al. | |
| 7,549,471 | B2 * | 6/2009 | Aivalis et al. | 166/254.2 |
| 7,841,400 | B2 * | 11/2010 | Wells et al. | 166/242.6 |
| 2004/0074639 | A1 | 4/2004 | Runia | |
| 2004/0118611 | A1 | 6/2004 | Runia et al. | |
| 2004/0238218 | A1 * | 12/2004 | Runia et al. | 175/57 |
| 2005/0029017 | A1 | 2/2005 | Berkheimer et al. | |
| 2006/0000619 | A1 | 1/2006 | Borst et al. | |
| 2006/0118298 | A1 | 6/2006 | Millar et al. | |
| 2006/0266512 | A1 | 11/2006 | Lohbeck | |
| 2007/0068677 | A1 | 3/2007 | Angman et al. | |
| 2007/0126595 | A1 * | 6/2007 | Murphy | 340/853.7 |
| 2008/0066905 | A1 | 3/2008 | Aivalis et al. | |
| 2008/0066961 | A1 | 3/2008 | Aivalis et al. | |
| 2008/0156477 | A1 | 7/2008 | Aivalis et al. | |
| 2008/0173481 | A1 | 7/2008 | Menezes et al. | |
| 2009/0038391 | A1 | 2/2009 | Avialis et al. | |

FOREIGN PATENT DOCUMENTS

| | | |
|---|---|---|
| WO | WO0165057 | 9/2001 |
| WO | WO03004825 | 1/2003 |
| WO | WO03010410 | 2/2003 |
| WO | WO2004046505 | 6/2004 |
| WO | WO2004063522 | 7/2004 |

OTHER PUBLICATIONS

Runia, John, et al., "Technologies Leading Way to New Through-Bit, Through Bore Capabilities in Well Logging and Drilling," The American Oil & Gas Reporter, pp. 68-77.

Runia, John, et al., "Through Bit Logging: Applications in Difficult Wells, Offshore North Sea," SPE/IADC Drilling Conference, Feb. 23-25, 2005, pp. 1-8.

Runia, John, et al., "Through Bit Logging: A New Method to Acquire Log Data, and a First Step on the Road to Through Bore Drilling," SPWLA 45th Annual Logging Symposium, Jun. 6-9, 2004, pp. 1-8.

ThruBit Logging Solutions Brochure, pp. 1-4.

Mahony, James, "Through-Bit Technology May Brighten the Outlook for Tough Logging Conditions," New Technology Magazine, Sep. 2004, pp. 1-3.

* cited by examiner

DRILL BIT ASSEMBLY AND METHOD OF PERFORMING AN OPERATION IN A WELLBORE

PRIORITY CLAIM

The present application claims priority of PCT Application EP2008/054320, filed 10 Apr. 2008, which claims priority to European Patent Application No. 07106015.6 filed 12 Apr. 2007.

FIELD OF THE INVENTION

The present invention relates to a drill bit assembly for operating a tool through a drill bit. The invention further relates to the use of such a drill bit assembly when attached to a drill string, in a method of performing an operation in a wellbore surrounding the drill bit.

BACKGROUND OF THE INVENTION

International patent application with publication No. WO 00/17488 discloses a system for drilling and logging of a wellbore formed in an earth formation, wherein a logging tool can be lowered in the wellbore from inside a drill string through a well drilling bit at the lower end of the drill string.

The known system comprises a drill bit including a bit body provided with a passageway for the logging tool, and a closure element for the passageway in the form of an insert section at the bit face. The bit body is attachable to a tubular drill string at a drill-string side of the bit body, and the passageway extends during normal operation in a well from an opening at the drill-string side to the well exterior of the bit body. The closure element comprises a bit-connecting means in the form of a primary latching device for selectively connecting the closure element to the bit body, so as to selectively close the passageway.

The latching device can be manipulated by an auxiliary tool that forms the downstream part of a logging tool string.

In the present specification and in the claims the terms upstream, upper and downstream, lower are used in relation to the lowering of a tool into a borehole, so that upstream, upper is closer to the surface than downstream, lower.

The logging tool string of the known system is arranged so that it can pass from the attached drill string through the opening of the bit body at the drill-string side, along the passageway so that it can reach the closure element, when the closure element is connected to the bit body. The auxiliary tool comprises a tool-connecting means in the form of a secondary latching device for selectively connecting the auxiliary tool to the closure element, so that the closure element is not lost in the wellbore when it is disconnected from the bit body.

The well drilling bit of the known system can be used for drilling operation, when the closure element is connected to the bit body. When it is desired to log the formation, drilling operation is stopped, and the logging tool string with the auxiliary tool at its lower end is lowered through the drill string into the passageway. The tool-connecting means (secondary latching mechanism) is connected to the closure element, and, simultaneously, the bit-connecting means (primary latching mechanism) is operated so as to release the closure element from the bit body. Then, the logging tool with the closure element attached to its lower end can be lowered into the wellbore ahead of the well drilling bit from where logging can be performed. After logging has been completed, the logging tool string can be pulled back into the drill string, so that the closure element is re-connected to the bit body and the auxiliary tool is simultaneously disconnected from the closure element.

International patent applications with publication Numbers WO03/004825, WO03/010410, WO2004/046505, WO2004/063522 disclose other embodiments of systems and methods for performing an operation in a wellbore ahead of a drill bit, wherein a tool is passed through a passageway in the bit body, connected to the closure element, and passed further to an external position in the borehole ahead of the bit body with the closure element connected to the lower end of the tool, at which external position the tool can be used to perform the operation.

While it is generally desirable to be able to re-connect to closure element to the drill bit after the operation in the borehole has been completed, it has been found that for some operations it is undesirable to have the closure element attached to the lower end of the tool.

It is an object of the present invention to provide a drill bit assembly that allows a tool to pass through the drill bit into the wellbore ahead, without having to connect to the closure element at the lower end of the tool.

It is a further object to provide a method for performing an operation in a wellbore wherein a tool is passed through a drill bit without having to connect the closure element at its lower end.

SUMMARY OF THE INVENTION

In accordance with the present invention there is provided a drill bit assembly comprising a bit body connectable to a tubular drill string, which bit body is provided with a longitudinal passageway for an operating tool from an internal position in an attached drill string to an external position;

a closure element for closing, when the closure element is in a closing position, the passageway for passage of the tool, which closure element is externally removable; and a passage tool attached to or connectable to the closure element in its closing position from inside the bit body, wherein the passage tool comprises a lower part to which the closure element is attached or connectable, which lower part is arranged so that it can be moved out of the bit body together with the closure element, and an upper tubular part which is arranged so that it can be moved along the passageway in the bit body, the upper tubular part forming a passage with a downstream opening for the operating tool, when the lower part of the passage tool has been moved out of the bit body.

Applicant has realized that the closure element does not need to be secured by the operating tool itself. Rather it can be secured using a passage tool, which provides a pathway for the operating tool into the wellbore that is not obstructed by the closure element. The tubular upper part of the passage tool remains at least partly in the passageway of the bit body and serves by itself as a passageway for the operating tool, from an upstream position in the drillstring to a port at its lower end, through which the operating tool can pass.

A particularly suitable passage tool is a hinge tool comprising a hinge joint between the upper and lower parts, in particular wherein the hinge joint is a double hinged joint. With a hinge tool, the closure element can be pivoted away, so that optimum access to the wellbore can be achieved. The lower part of the hinge tool to which the closure element is connected is pivotably connected to the upper part. The closure element can be pivoted away such that a port at the lower end of the upper part is sufficiently unobstructed for the operating tool to pass through and to enter the open wellbore adjacent the closure element.

Suitably, the hinge tool is arranged such that in the wellbore ahead of the bit body, the lower part can pivot sufficiently with respect to the upper tubular part that an elongated tool can be passed from an interior position to a position in the wellbore past the closure element. The tool can thus reach a position well beyond the drill bit and closure element, and therefore unobstructed in the wellbore.

Preferably the assembly is arranged to provide a passageway for a tool substantially parallel to or coaxial with the axis, in this way relatively long tools can be passed into the wellbore, such as tools longer than 1 m or more, 10 m or more, even 100 m or more.

In an advantageous embodiment the hinge joint is a double hinged joint. In this way a minimum obstruction of the port in the upper part is achieved, and maximum space for the operating tool immediately below the drill bit.

Suitably the lower part of the hinge tool and/or the closure element are provided with an excentraliser or other biasing means, so that the closure element is biased away from the axis of the upper tubular part, i.e. kept in a hinged position in the wellbore.

The invention also provides the use of the drill bit assembly in a method of performing an operation in a wellbore. In particular there is provided a method of performing an operation in a wellbore, which method comprises the steps of arranging a drill string in the wellbore with the drill bit assembly of the invention at its lower end, and some distance above the bottom of the wellbore;

removing the closure element from its closing position on the bit body, and passing the closure element with the attached passage tool into the wellbore, to reach a position wherein the downstream opening of the upper part of the passage tool has passed through the passageway of the bit body, but wherein at least part of the upper tubular part still resides in the passageway of the bit body;

passing an operating tool from a position inside the drill string via the passage formed by the tubular drill string, bit body and upper tubular part of the passage tool through the downstream opening of the upper part of the passage tool, to reach a position in the wellbore, and to performing the operation.

Applicant has realised that the method wherein the tool can be passed through the drill bit without the closure element at its end can be beneficial in a variety of operations.

When for example an object has to be placed in a wellbore, such as a sensor, geophone, pressure transducer or the like, the closure element should not be sacrificed. The method of the invention allows direct and unobstructed access to the wellbore ahead of the drill bit. The object as such can be dropped or passed down from surface or from a position inside the drill string through the passageway. It is also possible that a placement tool is passed down, which releases an object or disconnects from the object once the position in the wellbore ahead of the drill bit has been reached. When the closure element would be connected to the lower end of the placement tool, e.g. dropping an object into the wellbore would not be possible without sacrificing the closure element.

Also in other situations it can be desirable to not have the closure element at the lower end of the operating tool, e.g. for injecting a fluid (such as cement, lost circulation material, or a cleaning fluid) into the wellbore; for obtaining a sample from the wellbore; for obtaining a sample from the formation surrounding the wellbore, for example obtaining a core sample or obtaining a fluid sample; for performing a measurement such as logging.

When the operation comprises placement of an object in the wellbore, and the passage can also be used for passing cement into the wellbore so as to cement the object into position.

In an advantageous embodiment the passage tool is a hinge tool comprising a hinge joint between the upper and lower parts, and wherein the lower part is pivoted against the upper part before or during passage of the operating tool through the downstream opening.

BRIEF DESCRIPTION OF THE DRAWINGS

Embodiments of the invention will now be described in more detail and with reference to the accompanying drawings, wherein.

Where the same reference numerals are used in different Figures, they refer to the same or similar objects.

DETAILED DESCRIPTION OF THE INVENTION

Figure 1:
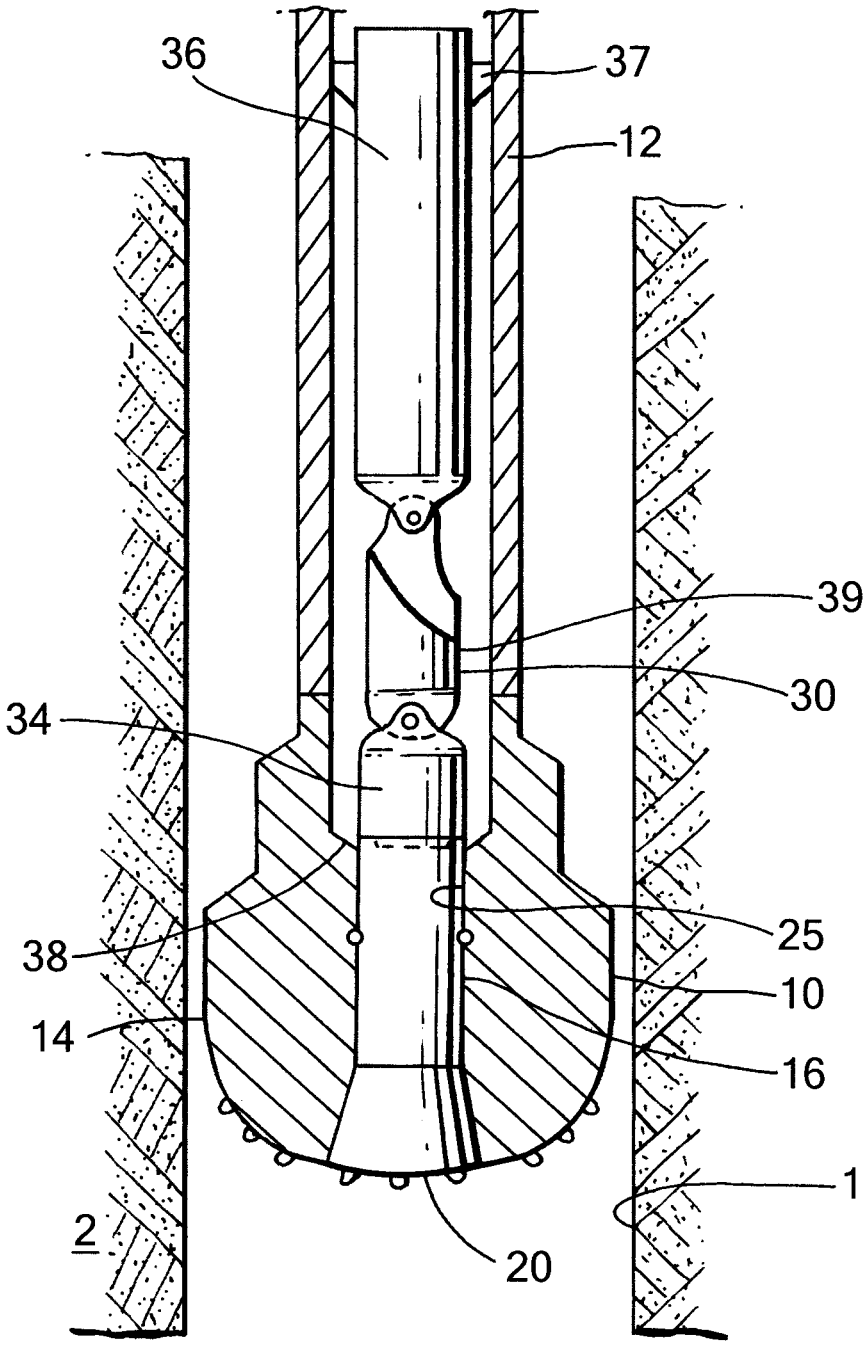
FIG. 1 shows schematically a first embodiment of the invention with a double hinged passage tool, and with the closure element still in its closing position.

Reference is made to FIG. 1, showing a borehole 1 extending from surface (not shown) into an underground formation 2. Typically at least the lower part of the borehole that is shown in the Figure is formed by the operation of the drill bit 10. The drill bit 10 is shown connected to a tubular drill string 12. The drill bit comprises a bit body 14 provided with a longitudinal passageway 16 and a closure element 20 for the passageway 16. FIG. 1 shows the closure element in a closing position with respect to the passageway, wherein it is latched via releasable latching means 25 to the bit body 14.

FIG. 1 moreover shows a passage tool in the form of hinge tool 30, attached to the closure element 20 via the latching means 25. The hinge tool extends into the drill string 12 and comprises a lower part 34 to which the closure element 20 is attached, and an upper tubular part 36 of an outer diameter small enough that it can move at least partially into the passageway 16 in the bit body 14. The upper part is provided with a hang-off device 37 at its upper end, co-operating with a shoulder 38 in the bit body. Upper and lower parts 34 and 36 of the hinge tool are connected by a double hinge joint 39. The bit body 14, closure element 20 and hinge tool 30 together form a drill bit assembly.

Figure 2:
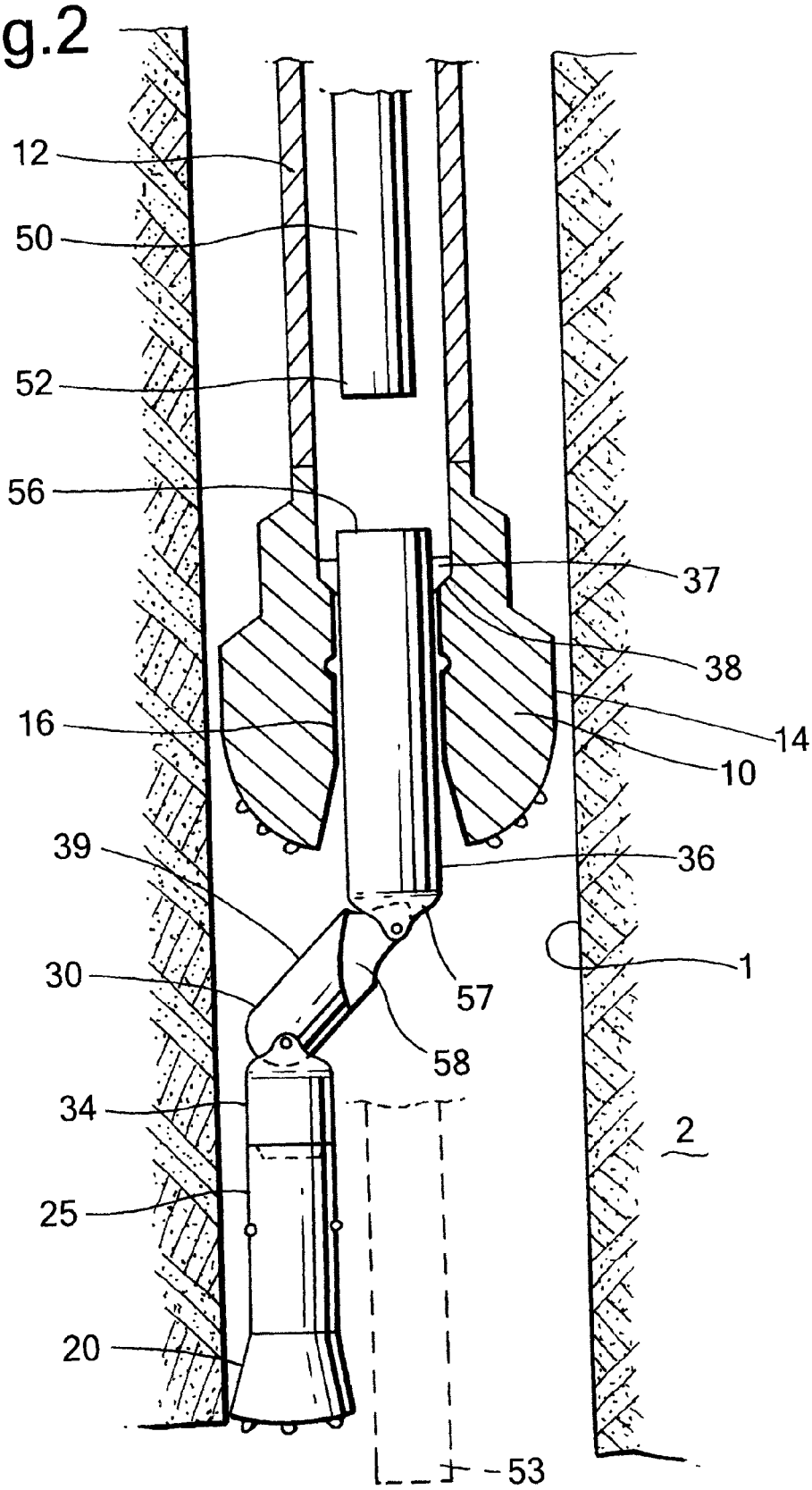
FIG. 2 shows schematically the first embodiment with the closure element outwardly removed, and with the passage tool providing a passageway for an operating tool.

Reference is now made to FIG. 2, showing the drill bit assembly in a different state of operation. In FIG. 2, the latching mechanism 25 connecting the closure element 20 to the bit body 14 has been released and the closure element has been outwardly removed, into the wellbore 1 exterior from the bit body 14 and drill string 12. The hinge tool 30 is hung off in the bit body.

The double hinge tool 30 is shown in a pivoted arrangement, wherein the lower part 34 connected to the closure element 20 is pivoted away from the longitudinal axis of the wellbore 1 (typically coinciding with the axes of the bit body 14, passageway 16, and drill string 12), and the against the wall of the borehole 1.

The upper part 36 is tubular having an inner diameter large enough for an operating tool 50 to pass from internal position 52 in the drill string 12 to an external position, which is indicated with reference numeral 53. Thus, the upper part 36 forms a passage from an upstream opening 56 to a downstream opening 57 for the operating tool, when the lower part 34 of the passage tool 30 has been moved out of the bit body 14.

In order to allow the operating tool 50 to pass through the double hinge tool, the upper part of the double hinge joint 39 is provided with an deflection surface 58 which is arranged co-operate with a tool that is passed outwardly through the tubular part so as to pivot the lower part with respect to the upper tubular part. When the deflection surface 58 is engaged by the operating tool 50 on its way down, so that the hinge joint is operated and the lower part 34 is moved out of the way.

The double hinge tool 30 allows the lower part 34 to pivot sufficiently with respect to the upper tubular part that the elongated operating tool can be passed from an interior position to a position in the wellbore past the closure element, and in fact along the longitudinal axis of the drill string 12 and passageway 16. In the hinged position as shown in FIG. 2, the opening 57 at the lower end of the upper tubular part is unobstructed, and an elongated tool can pass through, along the longitudinal axis of the wellbore.

The hinge can be passively operated by the progression of the operating tool, such as discussed. It can also be an active hinge which is operated e.g. electrically or hydraulically.

The passage tool can be provided with means to push the lower part and closure element against the borehole wall, e.g. an excentraliser, for example comprising spring means that laterally expand when the lower part moves out of the bit body.

Figure 3:
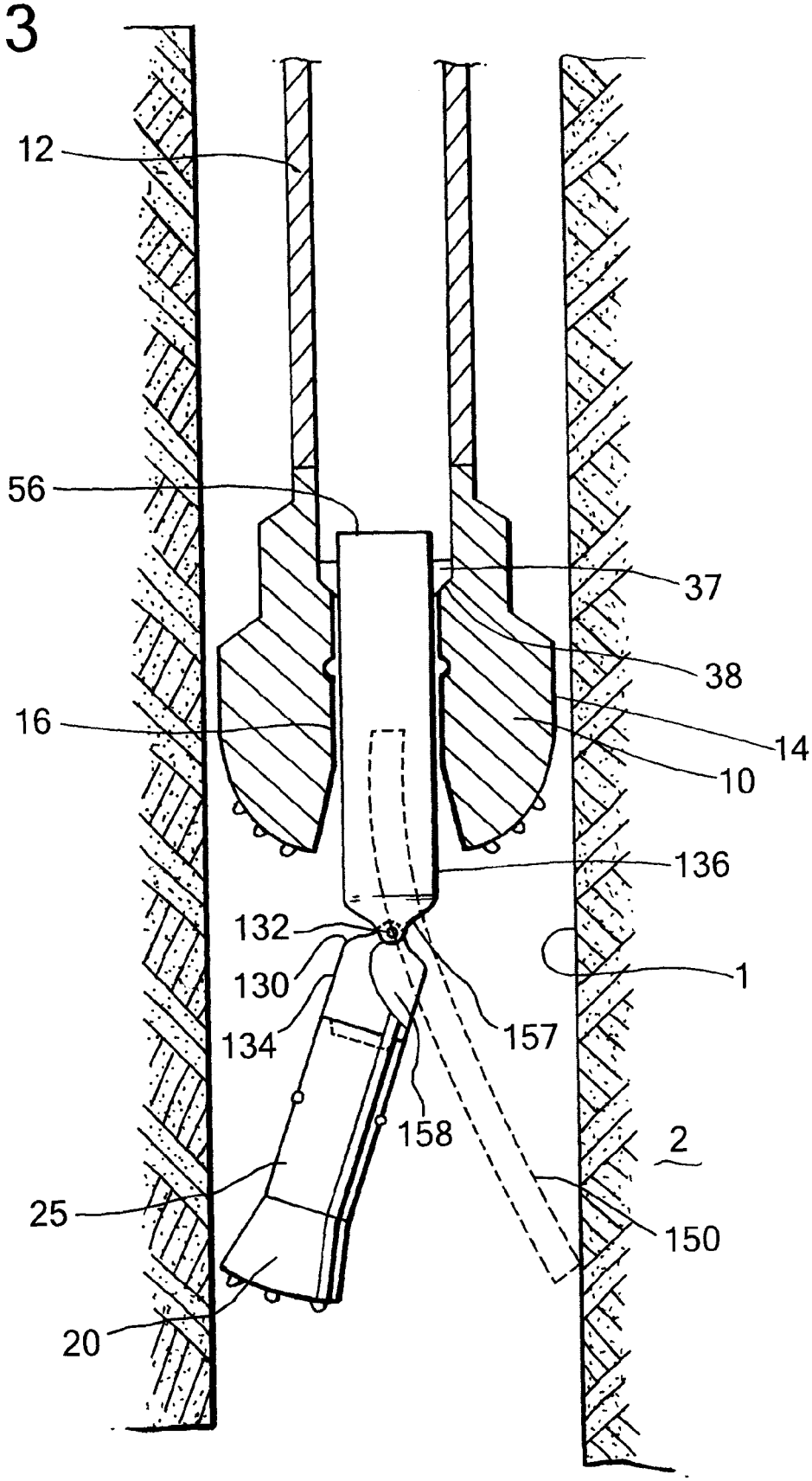
FIG. 3 shows schematically a second embodiment of the invention with a hinged passage tool.

FIG. 3 shows another embodiment of the invention, wherein the main difference with the embodiment of FIGS. 1 and 2 is in the passage tool. The passage tool 130 of FIG. 3 has is a hinge tool with a single joint 132 pivotably connecting the lower part 134 to the upper part 136. The closure element 20 connected to the lower end of the hinge tool can be pivoted towards the wall of the wellbore 1. Through the tubular upper part 136 with the downstream opening 157 an operating tool 150 can be passed into the wellbore 1. The passageway created in this way can be sufficiently large for smaller or in fact flexible operating tools, or in particular tools that are to engage the wellbore wall as shown. Such tools can for example serve for a fluid sampling from the formation, taking a rock sample, performing a measurement, carrying out a repair operation, or drilling a pilot hole in a direction deviating from the wellbore 1. The upper end of the lower part 134 of the hinge tool has a suitably shaped deflection surface 158 such that a sufficiently large passageway is realized.

Figure 4:
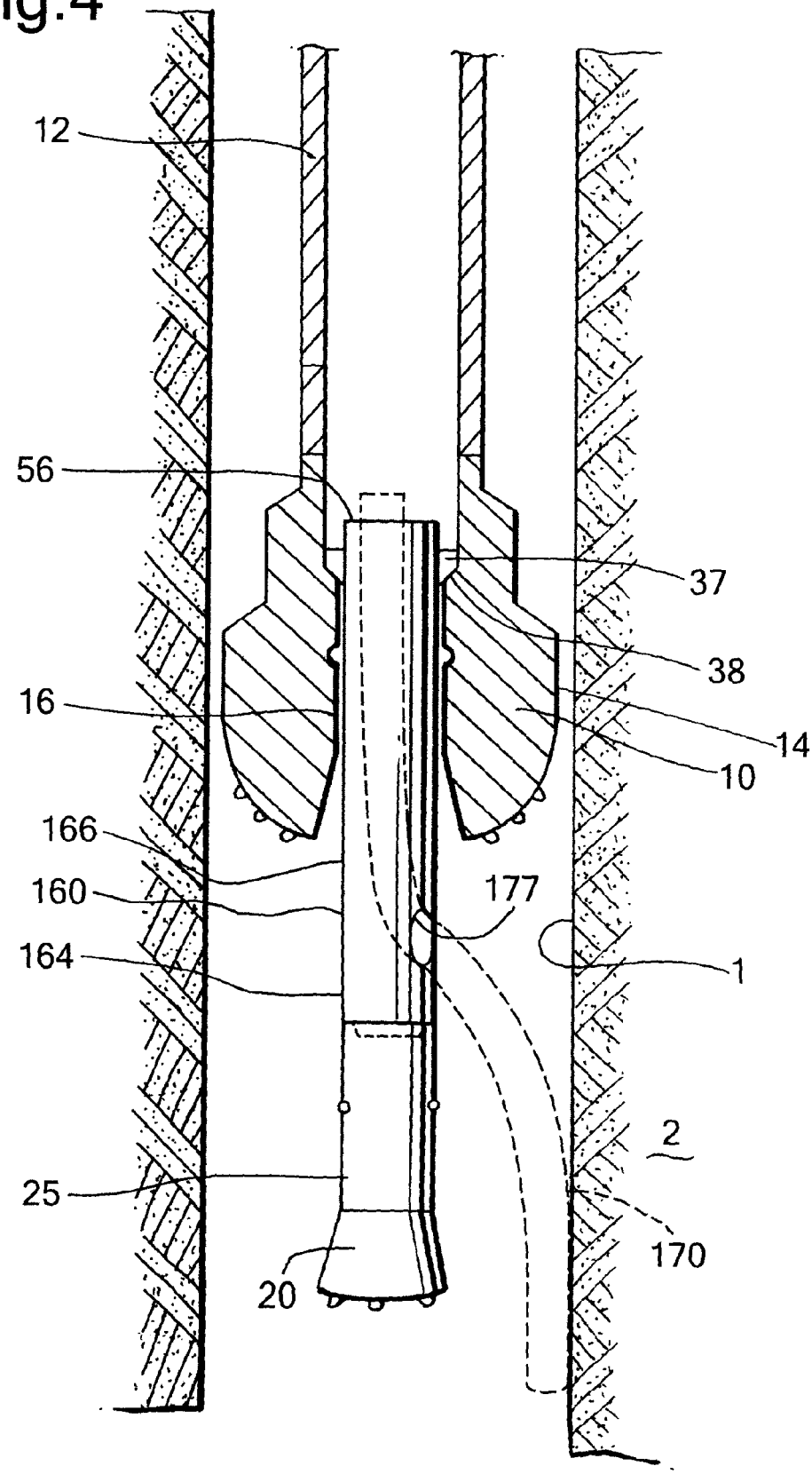
FIG. 4 shows a schematically a third embodiment of the invention.

Reference is made to FIG. 4, showing a passage tool 160 without a hinge joint. The lower part 164 is connected to the closure element 20. The upper part 166 provides a passage for an operating tool, in particular a flexible operating tool 170 through a lateral opening 177.

The passage tool of the present invention can be continuously connected or fixed to the closure element, and the bit-connecting function of the latching means 25 is in this case suitably arranged so that it can be operated via the passage tool. For example, by exerting an axial downward force onto the upper end of the passage tool after it has been connected to the latching means 25, such as by pumping a suitable tool down the drill string to engage and put downward force on the passage tool. Alternatively, and in fact preferably, the passage tool can be stored at surface in the course of the drilling operation, and lowered into the drill string at a time when operating a tool in the wellbore ahead of the drill bit is desired. A suitable latching means for connecting/disconnecting the passage tool to/from the closure element ("bit-connection"), and further connecting/disconnecting the closure element to/from the bit body ("tool-connection") will now be discussed.

Figure 5:
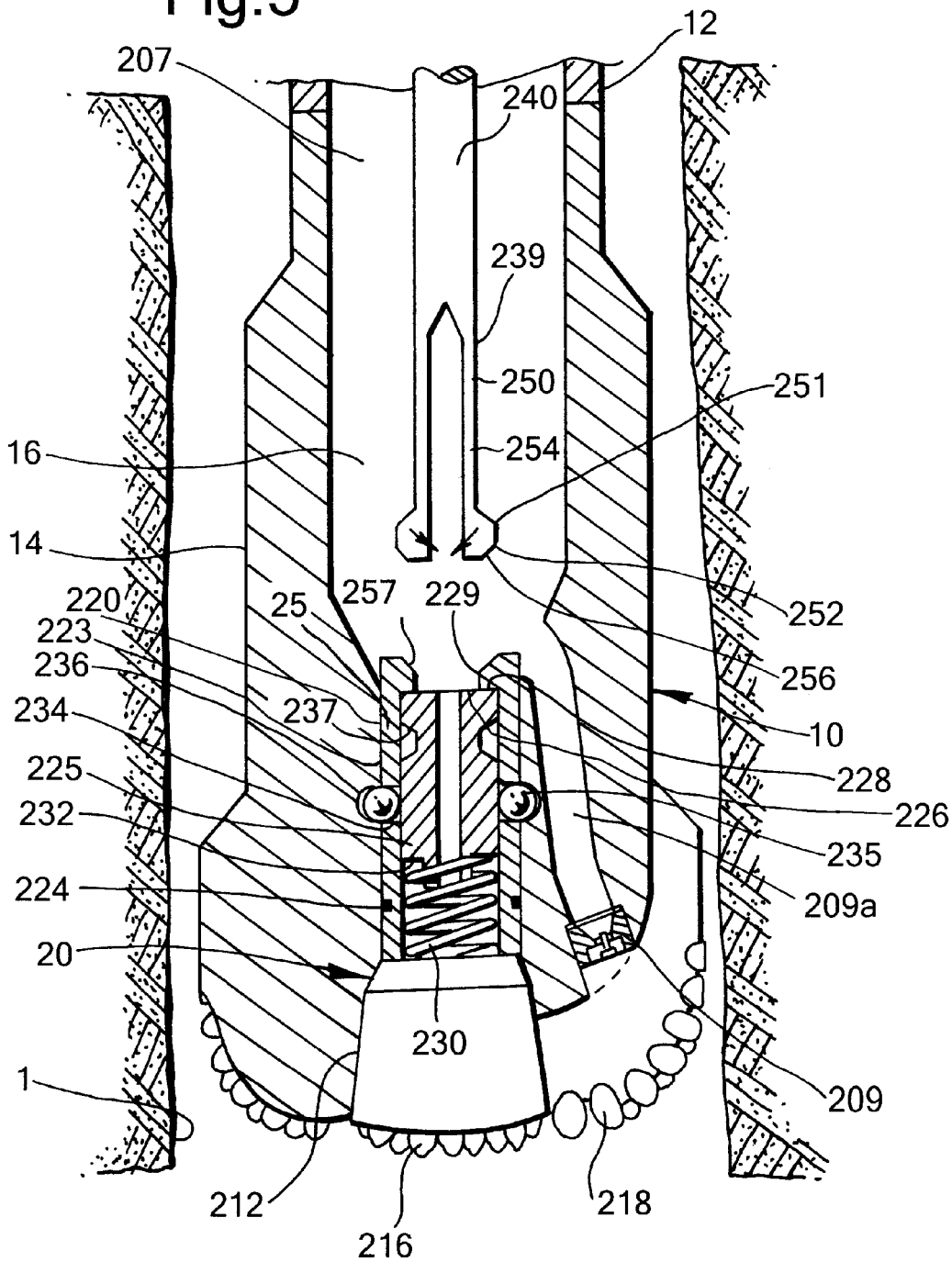
FIG. 5 shows schematically in more detail an embodiment of a latching mechanism for the closure element.

Reference is now made to FIG. 5, showing schematically a more detailed longitudinal cross-section of an embodiment of the rotary drill bit 10 of FIGS. 1-4. The drill bit 10 is shown in the borehole 1, and is attached to the drill string 12. The bit body 14 of the drill bit 10 has a central longitudinal passage 16 from the interior 207 of the drill string 12 to the borehole 1, exterior of the drill bit 10, as will be pointed out in more detail below. Bit nozzles are arranged in the bit body 14. Only one nozzle with insert 209 is shown for the sake of clarity. The nozzle 209 is connected to the passageway 16 via the nozzle channel 209*a*.

The drill bit 10 is further provided with a removable closure element 20, which is shown in FIG. 4 in its closing position with respect to the passageway 16. The closure element 20 of this example includes a central insert section 212 and a latching section 25. The insert section 212 is provided with cutting elements 216 at its front end, wherein the cutting elements are arranged so as to form, in the closing position, a joint bit face together with the cutters 218 at the front end of the bit body 14. The insert section can also be provided with nozzles (not shown). Further, the insert section and the cooperating surface of the bit body 206 are shaped suitably so as to allow transmission of drilling torque from the drill string 12 and bit body 14 to the insert section 212.

The latching section 25, which is fixedly attached to the rear end of the insert section 212, has substantially cylindrical shape and extends into a central longitudinal bore 220 in the bit body 14 with narrow clearance. The bore 220 forms part of the passage 16, it also provides fluid communication to nozzles in the insert section 212.

Via the latching section 25 the closure element 20 is removably attached to the bit body 14. The latching section 25 of the closure element 20 comprises a substantially cylindrical outer sleeve 223, which extends with narrow clearance along the bore 220. A sealing ring 224 is arranged in a groove around the circumference of the outer sleeve 223, to prevent fluid communication along the outer surface of the latching section 25. Connected to the lower end of the sleeve 223 is the insert section 212. The latching section 25 further comprises an inner sleeve 225, which slidingly fits into the outer sleeve 223. The inner sleeve 225 is biased with its upper end 226 against an inward shoulder 228 formed by an inward rim 229 near the upper end of the sleeve 223. The biasing force is exerted by a partly compressed helical spring 230, which pushes the inner sleeve 225 away from the insert section 212. At its lower end the inner sleeve 225 is provided with an annular recess 232 which is arranged to embrace the upper part of spring 230.

The outer sleeve 223 is provided with recesses 234 wherein locking balls 235 are arranged. A locking ball 235 has a larger diameter than the thickness of the wall of the sleeve 223, and each recess 234 is arranged to hold the respective ball 235 loosely so that it can move a limited distance radially in and out of the sleeve 223. Two locking balls 235 are shown in the drawing, however it will be clear that more locking balls can be arranged.

In the closing position as shown in FIG. 3 the locking balls 235 are pushed radially outwardly by the inner sleeve 225, and register with the annular recess 236 arranged in the bit body 206 around the bore 220. In this way the closure element 35 is locked to the drilling bit 10. The inner sleeve 225 is further provided with an annular recess 237, which is, in the closing position, longitudinally displaced with respect to the recess 236 in the direction of the bit shaft 110.

The inward rim 229 is arranged to cooperate with a connection means 239 at the lower end of an opening tool 240. The opening tool can form the lower part of the passage tool 30 of FIGS. 1-4. The connection means 239 is provided with a number of legs 250 extending longitudinally downwardly from the circumference of the opening tool 240. For the sake of clarity only two legs 250 are shown, but it will be clear that more legs can be arranged. Each leg 250 at its lower end is provided with a dog 251, such that the outer diameter defined by the dogs 251 at position 252 exceeds the outer diameter defined by the legs 250 at position 254, and also exceeds the inner diameter of the rim 229. Further, the inner diameter of the rim 229 is preferably larger or about equal to the outer diameter defined by the legs 250 at position 254, and the inner diameter of the outer sleeve 223 is smaller or approximately equal to the outer diameter defined by the dogs 251 at position 252. Further, the legs 250 are arranged so that they are inwardly elastically deformable as indicated by the arrows. The outer, lower edges 256 of the dogs 251 and the upper inner circumference 257 of the rim 229 are bevelled.

The outer diameter of the opening tool 240 is significantly smaller than the diameter of the bore 220.

The present invention allows to perform an operation in the open wellbore ahead of a drill bit, in the course of a drilling operation. The drill string 12 with drill bit 10 at its lower end can be used for progressing the borehole 1 into the formation 2. In the course of the drilling operation a situation can be encountered, which requires the operation of the operating tool 50 in the borehole 1 ahead of the drill bit 10/bit body 14. Examples are the occurrence of mud losses which require the injection of fluids such as lost circulation material or cement, performing a cleaning operation in the open borehole, the desire to perform a special logging, measurement, fluid sampling or coring operation, the desire to drill a pilot hole, or placement of an object in the wellbore.

Drilling is stopped then, the drill string is pulled up a certain distance to create sufficient space for the closure element to be outwardly removed from bit body 14, and the passageway is opened.

To this end the passage tool with an opening tool 240 at its lower end can then be deployed, through the interior of the drill string 12. The opening tool 240 suitably forms the lower end of the passage tool 30. The passage tool is suitably deployed from surface by disconnectable wireline, or by pumping such as by means of a transfer tool arranged at its upper end. For example, a transfer tool as disclosed in UK patent application No. GB 2 357 787 A can be used for this purpose.

The hinge tool 30 passes through the drill string till the upper end of the drill bit 10, so that the connection means 239 engages the upper end of the latching section 25 of the closure element 20. The dogs 251 slide into the upper rim 229 of the outer sleeve 223. The legs 250 are deformed inwardly so that the dogs can slide fully into the upper rim 229 until they engage the upper end 226 of the inner sleeve 225. By further pushing down, the inner sleeve 225 will be forced to slide down inside the outer sleeve 223, further compressing the spring 230. When the space between the upper end 226 of the inner sleeve 225 and the shoulder 228 has become large enough to accommodate the length of the dogs 251, the legs 250 snap outwardly, thereby latching the opening tool to the closure element 20.

At approximately the same relative position between inner and outer sleeves, where the legs snap outwardly, the recesses 237 register with the balls 235, thereby unlatching the closure element 20 from the bit body 14. At further pushing down of the opening tool the closure element is integrally pushed out of the bore 220.

When the closure element has been fully pushed out of the bore 220, the passageway 16 is opened.

By progressing the opening tool 240 further, the lower part 34 and the hinge joint 39 of the hinge tool 30 enter the open borehole exterior of the drill bit.

Now the operating tool 50 can be lowered from surface, or e.g. from a side pocket in the drill string, through the bit body 14 and the hinge tool 30, 130 into the open borehole 1, and can pivot away the lower part by engaging the deflection surface 58, 158.

After performing the operation in the wellbore, the operating tool 50 can be retrieved into the drill string 12 or to surface if desired. The surfaces engaged during retraction, such as the deflection surface 58, 158, are suitably shaped such that a smooth re-entry is possible. If desired a further operating tool can be deployed, operated and possibly retrieved.

The passage tool with the closure element can also be retracted, so that the closure element is re-latched to the bit body and drilling operation can be continued. Optionally the passage tool is then disconnected again from the closure element. Re-connecting the closure element can also be an option when the operating tool has not been retrieved, such as in the case of a placement of an object in the borehole outside of the drill string.

A placement operation is a particular application of the present invention. The operating tool can be the object to be placed, wherein the operation can simply be the release of the object from the drill string/bit body assembly. Such an object can for example be a sensor, such as a geophone or a pressure transducer. The sensor can be connected to one end of a wire of cable. The other end of the wire is suitably connected to a part of the drill bit assembly and/or the operating tool that can be retracted to surface, so that a wire connection from the surface to the downhole sensor can be established. After placement of an object, the passage can also be used for passing cement into the wellbore so as to cement the object into position, for example when the object is a sensor, for example a geophone or a pressure transducer.

The drill bit 10 can for example have an outer diameter of 21.6 cm (8.5 inch), with a passageway of 6.4 cm (2.5 inch). The lower part of the operating tool, which is the part that has passed out of the drill string into the open borehole, can in this case for example be substantially cylindrical with an outer diameter of 5 cm (2 inch).

After the operation in the borehole has been completed, the closure element can be reconnected to the bit body and the drilling operation can be resumed if desired. It is possible to leave the operating tool behind in the wellbore, e.g. when the operating tool is an object to be placed in the borehole. Alternatively the operating tool or part thereof can first be retrieved into the drill string 12 before the closure element is pulled back to the closing position.

At re-latching the closure element 20 will reconnect to the bit body 206. The opening tool 240 will disconnect from the insert 20, and the hinge tool 30 can be retrieved to the surface. If a following operation of a tool is desired, the whole cycle can start over again, wherein in particular a different operating tool can be used.

An alternative latching means for releasably connecting a bit body, closure element and an auxiliary tool such as the hinge tool is described in European patent application publication No. EP 1588016. An advantage of this alternative assembly is that it allows robust and fail-safe operation of the latching mechanism during both disconnecting and re-connecting.

What is claimed is:

1. A drill bit assembly comprising:

a bit body connectable to a tubular drill string, which bit body is provided with a longitudinal passageway therethrough for an operating tool to pass from an internal position in an attached drill string to an external position;

a closure element for closing the passageway when the closure element is in a closing position, which closure element is externally removable from the passageway; and a passage tool attached to or connectable to the closure element in its closing position and disposed inside the bit body when the closure element is in a closing position, wherein the passage tool comprises:

a lower part to which the closure element is attached or connectable, which lower part is arranged so that it can be moved out of the bit body together with the closure element, and an upper tubular part which is arranged so that it can be moved along the passageway in the bit body, the upper tubular part forming a passage with a downstream opening for the passage of at least a portion of the operating tool to a position external to the passage tool, when the lower part of the passage tool has been moved out of the bit body.

2. The drill bit assembly according to claim 1, wherein the passage tool is a hinge tool comprising a hinge joint between the upper and lower parts, in particular wherein the hinge joint is a double hinged joint.

3. The drill bit assembly according to claim 2, wherein the hinge tool is arranged such that in a wellbore ahead of the bit body the lower part can pivot sufficiently with respect to the upper tubular part that the operating tool can be passed from an interior position to a position in the wellbore past the closure element.

4. The drill bit assembly according to claim 1 wherein the bit body has an axis and wherein the assembly is arranged to provide a passageway for a tool substantially parallel to or coaxial with the axis.

5. A method of performing an operation in a wellbore, which method comprises:

arranging a drill string in the wellbore with a drill bit assembly according to claim 1 at its lower end, and a distance above the bottom of the wellbore;

removing the closure element from its closing position on the bit body, and passing the closure element with the attached passage tool into the wellbore, to reach a position wherein the downstream opening of the upper part of the passage tool has passed through the passageway of the bit body, but wherein at least part of the upper tubular part still resides in the passageway of the bit body;

passing an operating tool from a position inside the drill string via the passage formed by the tubular drill string, bit body, and upper tubular part of the passage tool through the downstream opening of the upper part of the passage tool, to reach a position in the wellbore, and performing the operation.

6. The method according to claim 5, wherein the passage tool is a hinge tool comprising a hinge joint between the upper and lower parts, and wherein the lower part is pivoted with respect to the upper part before or during passage of the operating tool through the downstream opening.

7. The method according to claim 5, wherein the operation is selected from the group consisting of placement of an object, injecting a fluid into the wellbore; obtaining a sample from the wellbore; obtaining a sample from the formation surrounding the wellbore, for example obtaining a core sample or obtaining a fluid sample; performing a measurement.

8. The method according to claim 5, wherein a plurality of operations are subsequently performed in the wellbore using different operating tools.

* * * * *